US006817914B2

(12) United States Patent
Breivik

(10) Patent No.: US 6,817,914 B2
(45) Date of Patent: Nov. 16, 2004

(54) SYSTEM FOR TRANSFERRING A LOAD FROM SHIP-BASED PRODUCTION AND STORAGE UNITS TO DYNAMICALLY POSITIONED TANKERS

(75) Inventor: Kåre G. Breivik, Tau (NO)

(73) Assignee: Statoil ASA, Stavanger (NO)

( * ) Notice: Subject to any disclaimer, the term of this patent is extended or adjusted under 35 U.S.C. 154(b) by 0 days.

(21) Appl. No.: 10/275,842

(22) PCT Filed: Jul. 19, 2001

(86) PCT No.: PCT/NO01/00312

§ 371 (c)(1),
(2), (4) Date: Jul. 24, 2003

(87) PCT Pub. No.: WO02/08116

PCT Pub. Date: Jan. 31, 2002

(65) Prior Publication Data

US 2004/0106339 A1 Jun. 3, 2004

(30) Foreign Application Priority Data

Jul. 20, 2000 (NO) ..... 20003736

(51) Int. Cl.[7] ..... B63B 22/02
(52) U.S. Cl. ..... 441/4; 414/137.9
(58) Field of Search ..... 441/4, 5, 23; 414/137.7, 414/137.9; 137/355.16; 141/279; 114/230.1, 230.2

(56) References Cited

U.S. PATENT DOCUMENTS

| | | | | |
|---|---|---|---|---|
| 3,766,938 A | * | 10/1973 | Stracke et al. | 137/355.16 |
| 3,833,032 A | * | 9/1974 | Hnot | 141/279 |
| 4,064,820 A | * | 12/1977 | Vogt | 141/279 |
| 5,064,329 A | * | 11/1991 | Brenna | 414/137.7 |
| 5,065,687 A | | 11/1991 | Hampton | |
| 5,145,429 A | * | 9/1992 | Stoddart et al. | 441/4 |
| 5,749,758 A | * | 5/1998 | Breivik et al. | 441/5 |
| 5,893,333 A | * | 4/1999 | Smedal | 441/4 |

* cited by examiner

*Primary Examiner*—Lars A. Olson
(74) *Attorney, Agent, or Firm*—Senniger Powers

(57) ABSTRACT

A system for transferring a load from ship-based production and storage units (10) to dynamically positioned tankers (3), comprising a loading hose (14) which, during a loading operation, extends between an end (11) of the ship-based unit (10) and a bow manifold (6) on the tanker (3), and which is stored on the ship-based unit (10) when not in use. The ship-based unit at said end is provided with two manifold and connecting means (12 resp. 13) located on either side of the fore-and aft axis (X—X) of the unit (10), and the ends of the loading hose (14) are arranged for connection to a respective one of the connecting means (12, 13), so that the hose, in connected condition, can hang like a catenary between the connecting means (12, 13) transversely to the ship-based unit (10), and an optional end of the hose (14) can be released from the connecting means in question, to be connected to the bow manifold (6) on the relevant tanker (3).

15 Claims, 4 Drawing Sheets

SYSTEM FOR TRANSFERRING A LOAD FROM SHIP-BASED PRODUCTION AND STORAGE UNITS TO DYNAMICALLY POSITIONED TANKERS

The invention relates to a system for transferring a load from ship-based production and storage units to dynamically positioned tankers, comprising a loading hose which, during a loading operation, extends between an end of the ship-based unit and a bow manifold on the tanker, and which is stored on the ship-based unit when not in use.

In connection with offshore loading of oil from so-called FSO and FPSO vessels, i.e. vessels for floating storage of oil (FSO=Floating Storage and Offloading) and for floating production and storage of oil (FPSO=Floating Production, Storage and Offloading), it is advantageous, especially in exposed ocean areas, to use DP-based buoy loading tankers (DP=dynamic positioning) in order to maintain a high continuity/loading regularity also in periods of bad weather.

FIG. 1 of the drawings schematically shows how ship and equipment typically is arranged to carry out such operations. The figure shows a ship-based storage and/or production unit 1 (i.e. an FSO or FPSO vessel) which is anchored by means of a turret anchoring 2, for example a so-called STP buoy, and a DP buoy loading tanker 3, wherein a loading hose 4 for the transfer of oil extends between the rearward end 5 of the unit 1 and a bow manifold 6 and an associated mooring arrangement on the tanker 3. The prevailing weather direction is designated "W" in the Figure.

The loading hose 4 typically is stored on a large hose reel 7 on the FSO/FPSO vessel 1 when the buoy loading tanker is not moored to the vessel.

The distance L1 between the tanker 3 and the vessel 1 typically is about 80 m. The distance between the vessels to some extent is delimited by the length of the hose 4. This is, inter alia, due to the fact that a long hose will require a larger hose reel 7, and also a stronger winch equipment on board the buoy loading tankers. When the tanker 3 is loading, the loading hose 4 hangs like a catenary between the vessel 1 and the manifold 6 on the tanker.

It is to be remarked that the DP-operated tanker 3 very often is connected to the FSO/FPSO vessel 1 lying in front by means of a mooring hawser 8, as shown in FIG. 1. The mooring hawser is stored on a hawser winch 9 on the vessel 1. The function of the mooring hawser is to prevent the hose 4 from being overloaded in cases wherein the distance between the vessels unintentionally becomes too large.

Traditionally, the mooring hawser 8 normally is placed in the region around the centre or fore-and-aft axis of the FSO/FPSO vessel, as illustrated in FIG. 1.

Experience shows that such DP loading is a very efficient loading method under marginal weather conditions. For example, a DP tanker will be able to carry out loading operations in waves having a significant wave height of $H_s$=5.5–6 m, as compared to a corresponding wave limitation of $H_s$=3.5–4 m for ships without DP.

However, it has occurred several times that DP ships move ahead in an uncontrolled manner. This type of occurrence, which is considered to be very critical since a contact or collision then might occur between the two vessels, is referred to in the field as "position drop out". Therefore, there is a need for a system which reduces the risk of possible damage effects in case of an occurring "position drop out".

Thus, it is an object of the invention to provide a load transferring system which reduces to a substantial degree the risk of contact/collision between the moored vessels during a loading operation, and which also gives the possibility of reducing the damage extent if a contact/collision nevertheless should occur.

A further object of the invention is to provide such a system which involves a simplification of the equipment forming part of the load transferring arrangement.

For achievement of the above-mentioned objects there is provided a system of the introductorily stated type which, according to the invention, is characterised in that the ship-based unit at said end is provided with two manifold and connecting means located at either side of the fore-and-aft axis of the unit, and that the ends of the loading hose are arranged for connection to a respective one of the connecting means, so that the hose, in connected condition, can hang like a catenary between the connecting means transversely to the ship-based unit, and an optional end of the hose can be released from the connecting means in question, to be connected to the bow manifold on the relevant tanker.

The invention will be further described below in connection with an exemplary embodiment with reference to the drawings, wherein FIG. 1 shows a schematic plan view of the above-mentioned previously known system;

FIG. 2 shows a schematic view of the rearward end portion of an FSO/FPSO vessel which is equipped with a system according to the invention;

FIGS. 3 and 4 respectively show a side view and a view seen from astern of the end portion of the vessel in FIG. 2, with associated system equipment;

Figure 2:
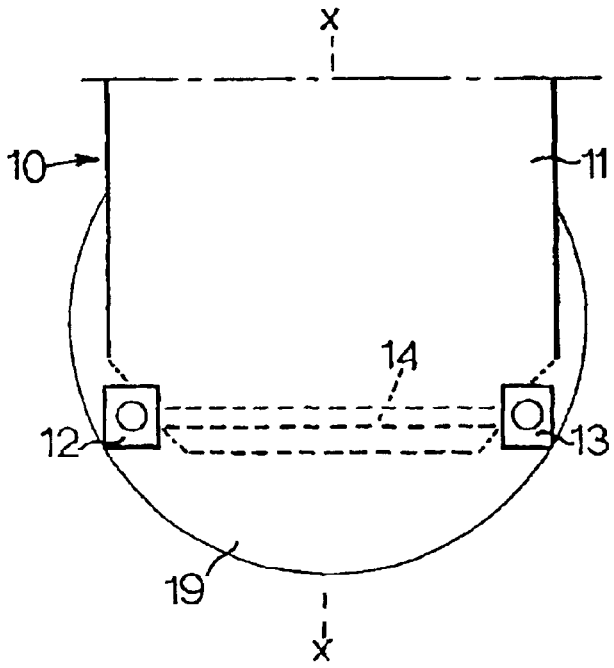
Figure 3:
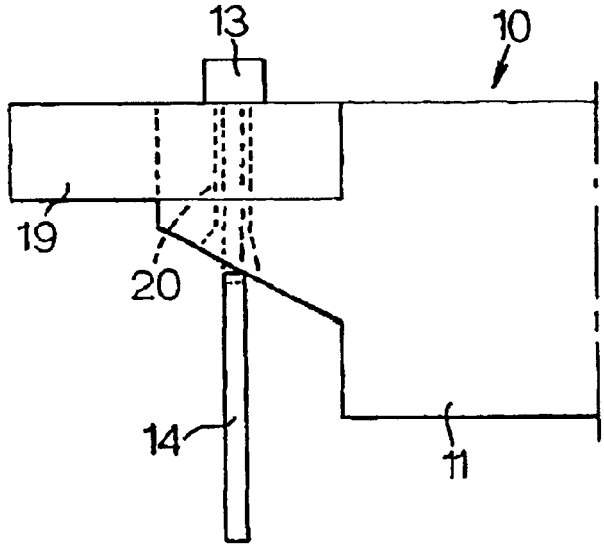
Figure 4:
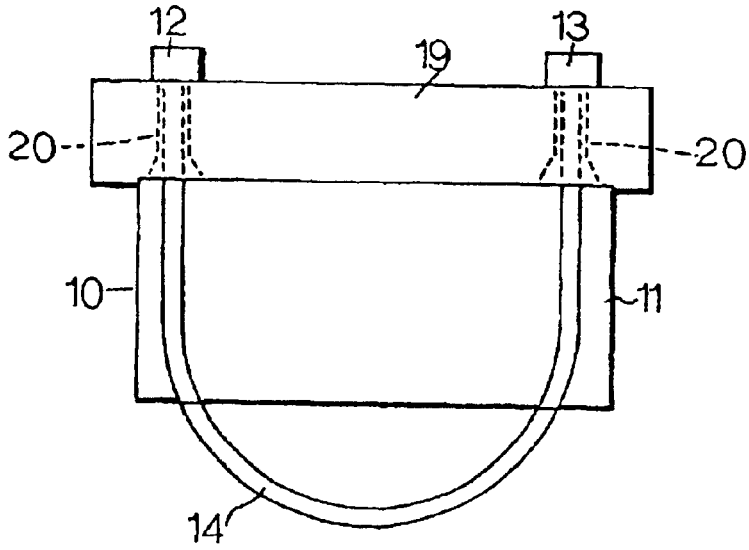

FIGS. 2–4 show an FSO or FPSO vessel 10 wherein a system according to the invention is arranged at the rearward end 11 of the vessel. As shown, the system comprises two manifold and connecting means 12 and 13, respectively, which are situated on either side of the centre or fore-and-aft axis X—X of the vessel. A loading hose 14 extends between and is connected to the connecting means, the ends of the loading hose being provided with connecting units for connection to a respective one of the connecting means 12 and 13, so that the hose in the illustrated connected condition, when loading does not take place, can hang like a catenary between the manifold and connecting means 12, 13, transversely to the vessel 10, as shown in FIG. 4. Thus, in this case the hose is not pulled in onto a hose reel on the FSO/FPSO vessel, as in the above-mentioned known solution.

Figure 5:
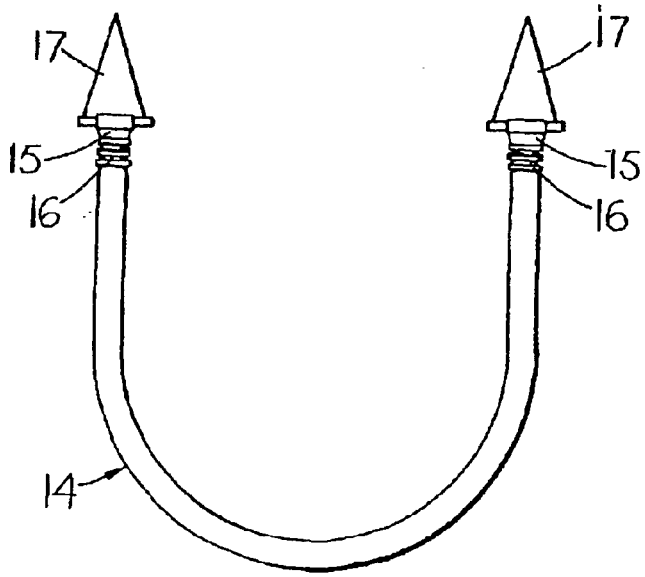
FIG. 5 shows a view of the loading hose forming part of the system.

As shown in FIG. 5, the loading hose 14 at each end is provided with connecting units in the form of a coupling head 15 which is connected to the hose via a swivel unit 16 allowing rotation of the hose. The coupling heads are of the standardized type which is also suitable for connection to the bow manifold on the relevant tankers which are to use the system. Thereby it is indifferent which end of the loading hose is connected to the tanker.

Each end of the hose 14 is also shown to be provided with a lifting bridle 17 for use in hoisting of the hose end in question, for connection to the relevant manifold and connecting means.

Figure 6:
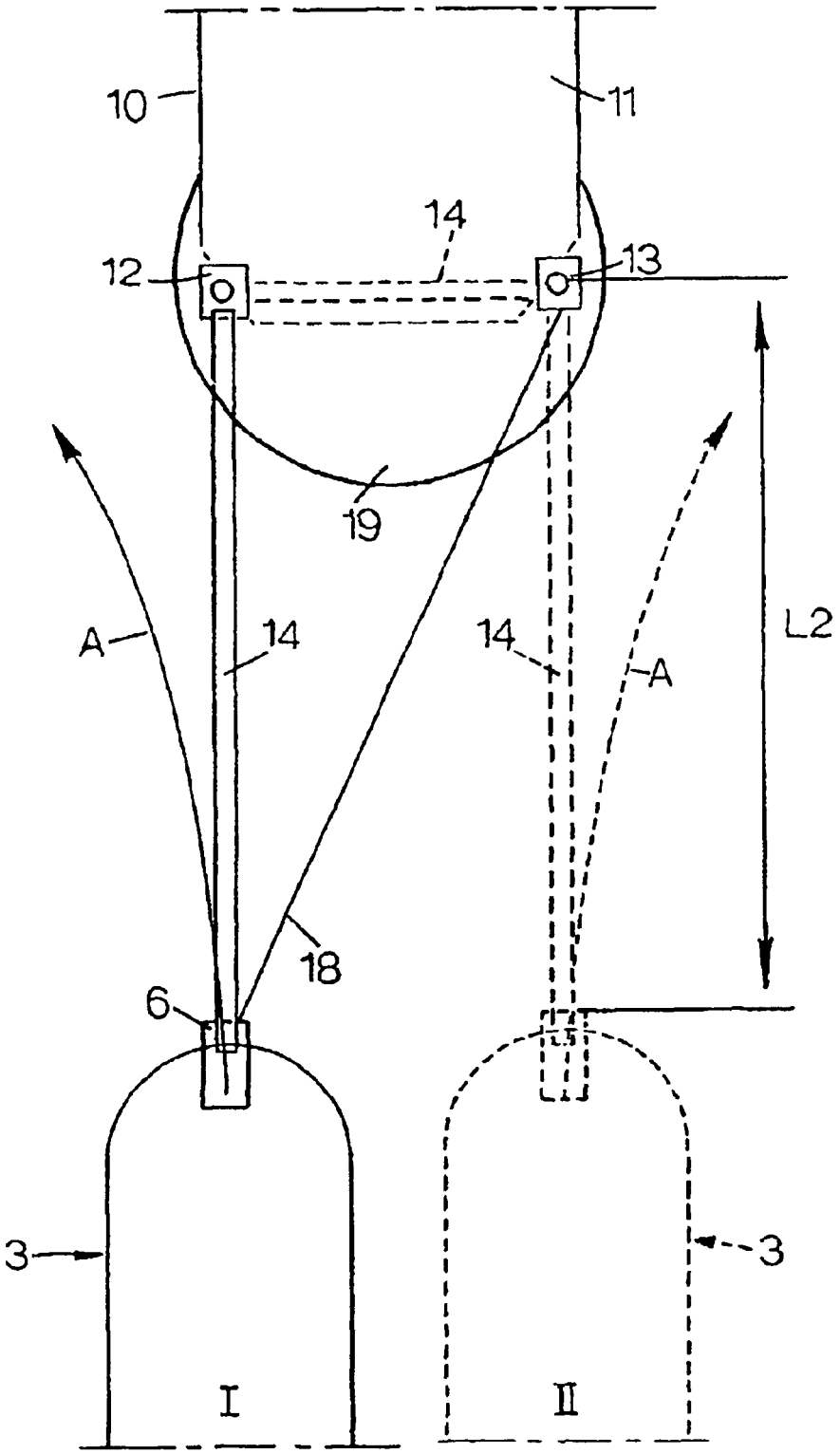
FIG. 6 shows a schematic plan view of an FSO/FPSO vessel and a DP-operated tanker during a loading operation with the system according to the invention.

FIG. 6 illustrates a loading operation wherein a DP-based tanker 3 is connected to the vessel 10 via the loading hose 14.

When the DP tanker 3 arrives, one can decide whether it is optimal to undertake connection on the port side or starboard side of the vessel 10, indicated as loading position I and loading position II in FIG. 6. The connection essentially takes place in the traditional manner in that a messenger line (not shown) is first transferred from the vessel 10 to the tanker 3. By means of this messenger line the loading hose 14 is then pulled over to the talker and is connected to the bow manifold 6.

If, during a loading operation, there should occur an unintentional "position drop out", or that the ship for other reasons moves ahead in an uncontrolled manner, the tanker, when it is connected in the respective loading positions on the port an starboard side, will more easily be able to manoeuvre laterally, so that contact/collision with the vessel 10 is avoided. This is illustrated by arrows A in FIG. 6.

When the loading operation has been carried out, the hose end in question is disconnected from the bow manifold of the tanker 3, and the hose end is pulled automatically back to the vessel 10 and is connected to the free connecting means. For this purpose the vessel 10 is equipped with a winch (not shown) and a handling line 18 forming part of each of the connecting means 12 and 13 on the vessel.

It is to be remarked here that the loading hose 14 in the present system in a simple manner will be able to be adapted with a somewhat larger length than if the hose is stored on the deck of the FSO/FPSO vessel. This is due to the fact that it will be more easy to pull in towards the tanker a hose which already hangs down into the sea. It is therefore supposed that the distance L2 between the two vessels in the present system advantageously will be able to be increased to typically 100 m.

Figure 1:
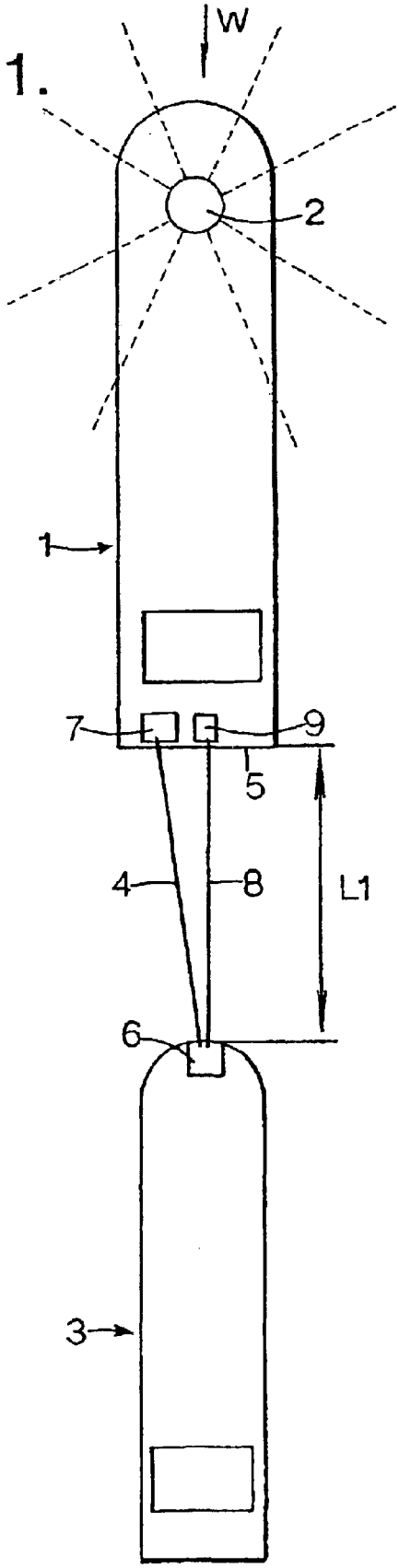

An increased distance to typically 100 m will, in combination with the novel hose arrangement, also contribute positively to secure against contact/collision between s the two vessels. The use of a somewhat longer hose will also reduce the necessity of using a mooring hawser, as described in connection with the solution according to FIG. 1. Thereby the disconnecting procedure is simplified, and the time required to carry out a disconnection, is reduced. With the present system it will typically be possible to disconnect the hose in a safe manner in ca. 15 seconds if a critical situation should occur. When using a mooring hawser, the disconnecting time will be more than 20 seconds.

Since the loading hose is connected to the manifold systems on the starboard and port side of the FSO/FPSO vessel when the hose is not in use, one will, with a suitable piping, be able to empty the hose of oil when it is in the connected, stored position. For example, this may be carried out by pressurizing the hose from one side. Alternatively, one may flush the hose clean after emptying, by pumping water through the hose.

The above described arrangement will be practically useful in connection with replacement of the loading hose and its equipment. Other known load transferring systems require that the loading hose is connected to the tanker in order to be able to carry out such operations.

As shown in FIGS. 2–4 and 6, the vessel 10 at its rearward end 11 is also provided with a special fender structure 19. This fender structure is designed to protect both the load transferring system, i.e. the loading hose 14 with associated equipment, and the primary structure of the vessel 10. As shown, the fender arrangement 19 projects a substantial distance outwards from the vessel 10, both at the rearward end and in each of the rearward side portions, and is provided with suitable openings 20 through which the end portions of the hose are pulled up for connection to the connecting means 12 and 13. The rounded shape of the fender arrangement entails that the tanker 3 in case of a possible contact with the vessel 10 will slide along the fender arrangement and apply a reduced impact energy to the structure.

What is claimed is:

1. A system for transferring a load from ship-based production and storage units (10) to dynamically positioned tankers (3), comprising a loading hose (14) which, during a loading operation, extends between an end (11) of the ship-based unit (10) and a bow manifold (6) on the tanker (3), and which is stored on the ship-based unit (10) when not in use, characterised in that the ship-based unit (10) at said end (11) is provided with two manifold and connecting means (12 resp. 13) located at either side of the fore-and-aft axis X—X of the unit (10), and that the ends of the loading hose (14) are arranged for connection to a respective one of the connecting means (12, 14), so that the hose, in connected condition, can hang with a shape essentially similar to a catenary between the connecting means (12, 13) transversely to the ship-based unit (10), and an optional end of the hose (14) can be released from the connecting means in question, to be connected the bow manifold (6) on the relevant tanker (3).

2. A system according to claim 1, characterised in that the loading hose (14) at each end is provided with a coupling head (15) which is connected to the loading hose via a swivel unit (16).

3. A system according to claim 2, characterised in that each of the coupling heads (15) is of a type suitable for connection to the bow manifold (6) on the relevant tanker (3).

4. A system according to claim 1, characterised in that the ship-based unit (10) is provided with a messenger line, for transferring the relevant end of the loading hose (14) to the tanker (3), for connection to the bow manifold (6) thereof.

5. A system according to claim 1, characterised in that the ship-based unit (10) is provided with a winch and an associated handling line (18) for pulling in the free end of the loading hose (14) after disconnection from the bow manifold (6) of the tanker.

6. A system according to claim 1, characterised in that the ship-based unit (10) at said end (11) is provided with a fender structure (19) which is designed so that a connected tanker (3) will slide along the fender structure (19) in case of a contact with the ship-based unit (10).

7. A system according to claim 2, characterised in that the ship-based unit (10 is provided with a messenger line, for transferring the relevant end of the loading hose (14) to the tanker (3), for connection to the bow manifold (6) thereof.

8. A system according to claim 3, characterised in that the ship-based unit (10) is provided with a messenger line, for transferring the relevant end of the loading hose (14) to the tanker (3), for connection to the bow manifold (6) thereof.

9. A system according to claim 2, characterised in that the ship-based unit (10) is provided with a winch and an associated handling line (18) for pulling in the free end of the loading hose (14) after disconnection from the bow manifold (6) of the tanker.

10. A system according to claim 3, characterised in that the ship-based unit (10) is provided with a winch and an associated handling line (18) for pulling in the free end of the loading hose (14) after disconnection from the bow manifold (6) of the tanker.

11. A system according to claim 4, characterised in that the ship-based unit (10) is provided with a winch and an associated handling line (18) for pulling in the free end of the loading hose (14) after disconnection from the bow manifold (6) of the tanker.

12. A system according to claim 2, characterised in that the ship-based unit (10) at said end (11) is provided with a fender structure (19) which is designed so that a connected tanker (3) will slide along the fender structure (19) in case of a contact with the ship-based unit (10).

13. A system according to claim 3, characterised in that the ship-based unit (10) at said end (11) is provided with a fender structure (19) which is designed so that a connected tanker (3) will slide along the fender structure (19) in case of a contact with the ship-based unit (10).

14. A system according to claim 4, characterised in that the ship-based unit (10) at said end (11) is provided with a fender structure (19) which is designed so that a connected tanker (3) will slide along the fender structure (19) in case of a contact with the ship-based unit (10).

15. A system according to claim 5, characterised in that the ship-based unit (10) at said end (11) is provided with a fender structure (19) which is designed so that a connected tanker (3) will slide along the fender structure (19) in case of a contact with the ship-based unit (10).

* * * * *